United States Patent [19]

Yamat et al.

[11] 4,227,161

[45] Oct. 7, 1980

[54] CURRENT LIMITING CIRCUIT BREAKER WITH PIVOTING CONTACT ARM

[75] Inventors: Miguel B. Yamat, Greendale, Wis.; John A. Wafer, Beaver, Pa.; Walter W. Lang, Rolla, Mo.

[73] Assignee: Westinghouse Electric Corp., Pittsburgh, Pa.

[21] Appl. No.: 951,938

[22] Filed: Oct. 16, 1978

[51] Int. Cl.[3] ..... H01H 77/10

[52] U.S. Cl. ..... 335/16; 335/194

[58] Field of Search ..... 335/16, 195, 194

[56] References Cited

U.S. PATENT DOCUMENTS

| | | | |
|---|---|---|---|
| 3,343,108 | 9/1967 | Murai | 335/16 |
| 3,469,216 | 9/1969 | Shiraiski | 335/16 |
| 3,815,059 | 6/1974 | Spoelman | 335/16 |

FOREIGN PATENT DOCUMENTS

| | | |
|---|---|---|
| 1193222 | 5/1970 | United Kingdom . |
| 1214363 | 12/1970 | United Kingdom . |

*Primary Examiner*—Harold Broome

*Attorney, Agent, or Firm*—Robert E. Converse, Jr.

[57] ABSTRACT

A current limiting circuit breaker includes two parallel pivoting contact arms carrying contacts at the ends thereof. The upper arm is double pivoted and is operated by a mechanism between open and closed positions. A magnetic drive slot motor device surrounds the lower arm and operates during extreme overcurrent conditions to draw the lower arm down and aid in rapidly separating the contacts. An arm positioning assembly is spring loaded to bias the lower arm toward a closed circuit position and provide contact closing force, the upper limit of travel being set by a rod extending through the end of the lower contact arm to abut against the slot motor.

10 Claims, 6 Drawing Figures

CLOSED POSITION

NORMAL OPEN POSITION

TRIP POSITION

CURRENT LIMITING POSITION

CURRENT LIMITING CIRCUIT BREAKER WITH PIVOTING CONTACT ARM

CROSS REFERENCE TO RELATED APPLICATIONS

The invention is related to material disclosed in copending U.S. Pat. application Ser. No. 951,940, entitled "Current Limiting Circuit Interrupter With Pivoting Contact Arm", filed Oct. 16, 1978 by John A. Wafer and Miguel B. Yamat, and U.S. Pat. application Ser. No. 951,939, entitled "Current Limiting Circuit Interrupter With Improved Operating Mechanism", filed Oct. 16, 1978 by Miguel B. Yamat.

BACKGROUND OF THE INVENTION

1. Field of the Invention:

The present invention relates to electrical apparatus, and more particularly, to current limiting circuit interrupters having pivoting contact arms.

2. Description of the Prior Art:

Circuit interrupters are widely used to provide protection for electrical distribution systems against damage caused by overload current conditions. As the capacity of power sources increased, it was necessary to provide increased interrupting capability for circuit breakers to properly protect the electrical distribution system. In order to provide this protection in a more economical manner, current limiting circuit interrupters were developed to limit the flow of fault current to a level below that which the source was capable of supplying.

One type of current limiting circuit interrupter employs a high-speed mechanism to rapidly separate the contacts upon occurrence of a fault condition to draw an arc therebetween, allowing the voltage drop across the arc to limit the current flow. The electrodynamic force produced by the overload current flow through the circuit interrupter is used to rapidly separate the contacts and drive the arc into an extinguishing device. The standard trip mechanism then actuates to maintain the contacts in the open circuit position.

All types of circuit breakers require a certain amount of contact closing force to reduce resistance between the contacts and, consequently, the amount of resistance heating generated during normal closed circuit conditions. This contact force is most commonly obtained by means of extension or compression springs attached to the contact support arm. The higher the current rating of the circuit breaker, the greater the required contact force.

It is desirable to provide a current limiting circuit breaker having a pivoting contact arm which provides sufficient contact closing force yet assumes open and closed circuit positions which minimize contact wear. In addition, it is desirable to provide such a circuit breaker employing a magnetic drive slot motor to aid in rapidly separating the contacts during extreme overcurrent conditions.

SUMMARY OF THE INVENTION

In accordance with a preferred embodiment of the present invention, there is provided a circuit interrupter which includes separable contacts, an arm assembly comprising first and second pivoting contact support arms, a slotted magnetic drive device disposed about the first arm, and an operating mechanism connected to the second arm for operating the contacts between engaged and disengaged positions. The first arm includes passive and active positioning means, the passive means comprising a member extending through the support arm to limit travel of the first arm in a direction toward contact engagement. The active positioning means comprises a bearing member abutting the first contact arm and a spring biasing the first contact arm in a direction toward contact engagement. Conductor means are provided to connect the contacts in series circuit relationship with a circuit being protected in a manner so that current flows in opposite directions through the contact arms.

DESCRIPTION OF THE PREFERRED EMBODIMENT

Figure 1:
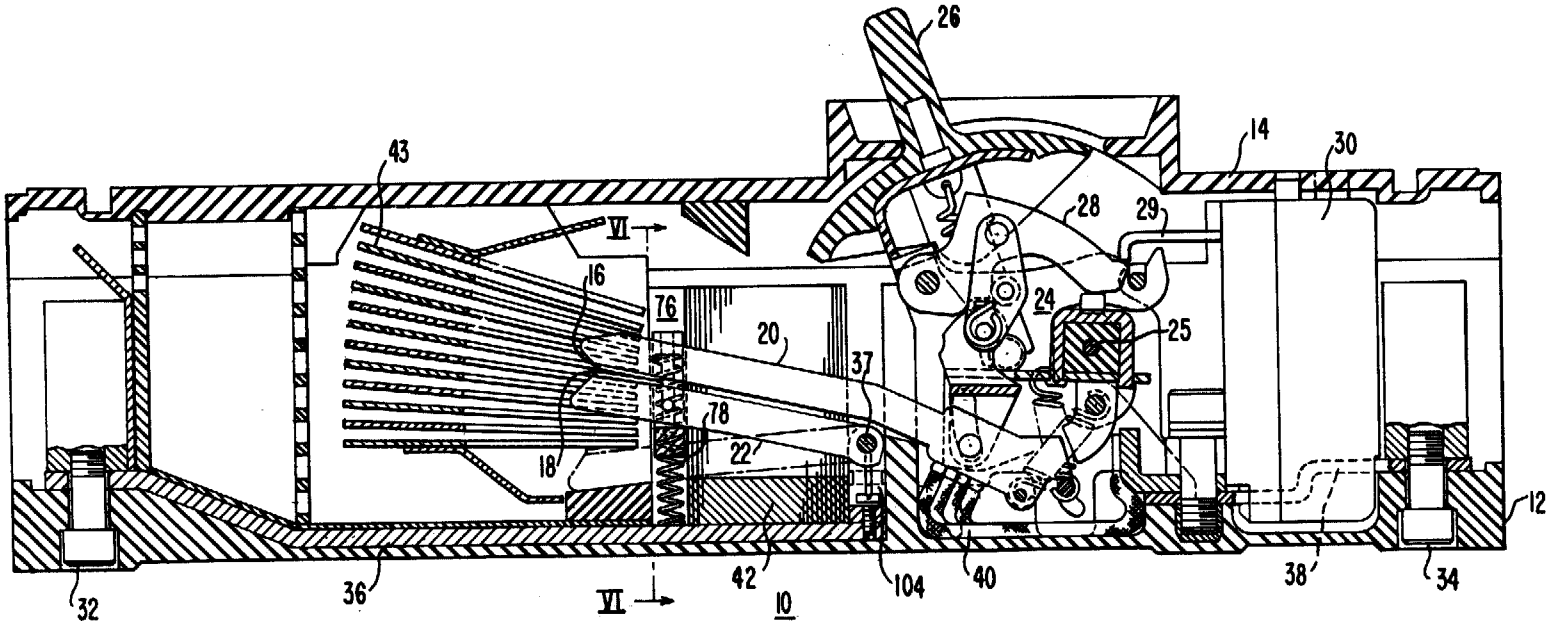
FIG. 1 is a side sectional view of a current limiting circuit breaker incorporating the principles of the present invention.

Referring now to the drawings, in which like reference characters refer to corresponding components, FIG. 1 shows a side sectional view of a current limiting circuit breaker 10 employing the principles of the present invention. The circuit breaker 10 includes a molded insulating housing 12 and a cooperating molded insulating cover 14. Upper and lower separable contacts 16, 18 are secured at the ends of upper and lower pivoting contact arms 20 and 22, respectively. The arm 20 pivots about a pin 48 and the arm 22 pivots about a pin 108. Movement of the upper contact arm 20 is controlled by an operating mechanism indicated generally at 24 which is adapted for manual operation through a handle 26. The lower contact arm 22 is positioned by a spring biased positioning asssembly 76 which includes a compression spring 78 and a bearing member 80, and a limit pin 82 parallel to the pin 108. The compression springs 78 resist the contact force produced by the upper contact arm 20 upon the lower arm 22.

Automatic opening operation upon normal overload currents is provided by a releasable latch 28 held during normal electrical conditions by a member 29 attached to a trip unit 30. The trip unit 30 may include thermal, magnetic, and shunt trip mechanisms of conventional design and will not be described here in detail. Low to moderate overload current conditions detected by the trip unit 30 will result in movement of the member 29 to the right to release the latch 28 and allow the contact arm 20 to pivot upward.

Terminals 32 and 34 are adapted to connect the circuit breaker 10 in series circuit relationship with an electrical circuit to be protected. Conductors 36 and 38 are connected to terminals 32 and 34 respectively. The lower contact arm 22 is electrically connected to the conductor 36 with a clinch-type contact 37 described more completely in the aforementioned U.S. Pat. application Ser. No. 951,940, about the pin 108. A conductive shunt 40 is electrically connected between the upper contact arm 20 and the conductor 38. With the circuit interrupter 10 in the closed circuit position as shown in FIG. 1, an electrical circuit thus exists through terminal 32, conductor 36, connection 37, contact arm 22, contact 18, contact 16, upper contact arm 20, shunt 40, and conductor 38 to terminal 34. A magnetic drive, or slot motor, 42 operates to aid in rapid separation of the contact arms 20, 22 during current limiting operation, as will be more completely described hereinafter. Plates 43 are provided to aid in extinguishing an arc established by separation of the contacts 16, 18.

Figure 2:
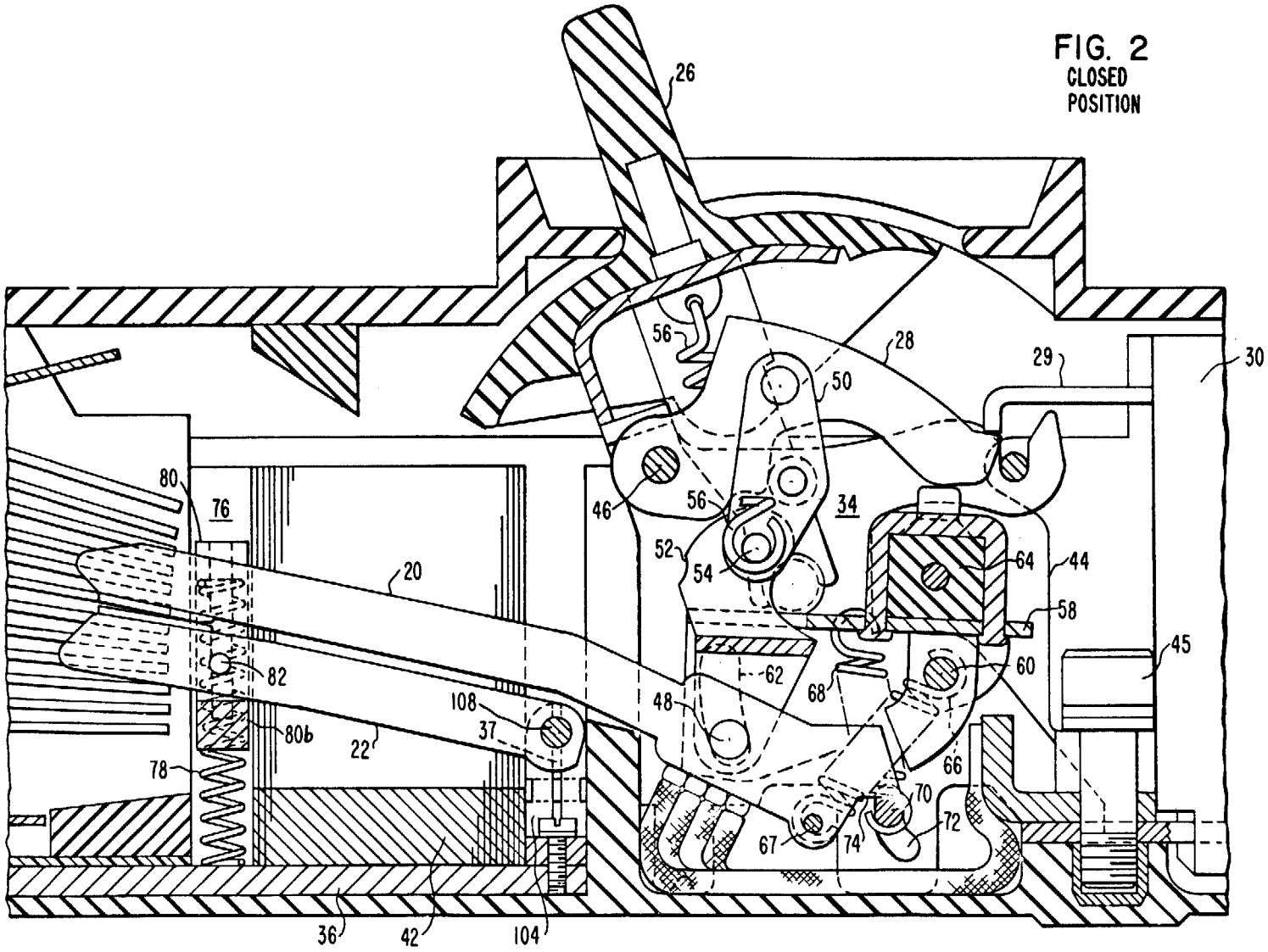
FIG. 2 is a detail side sectional view of the contact arms and operating mechanism of the circuit interrupter shown in FIG. 1, with the contacts in the closed position.

The construction of the operating mechanism 24 is shown in more detail in FIG. 2. A mechanism frame having side plate members 44 is secured to the housing 12 by a screw 45. The trip latch 28 is attached by a latch pivot pin 46 to the side plates 44. A toggle linkage consisting of an upper toggle link 50 and a lower toggle link 52 is pivotally connected between the trip latch 28 and the upper contact arm pivot pin 48. The upper and lower toggle links 50, 52, are joined by a toggle knee pin 54, to which is attached an operating spring 56, also connected to the handle 26.

A U-shaped carriage 58 is pivotally mounted to the side plates 44 upon a carriage pivot pin 60. The upper contact arm pivot pin 48 is mounted in the carriage 58. Therefore, during normal (non-current limiting) operations, the upper contact arm 20 pivots as a unit with the U-shaped carriage 58 about the rod 60. Since the lower toggle link 52 extends through the carriage 58 and is pivotally attached to the contact arm pivot pin 48, the extension or collapse of the toggle linkage 50, 52 serves to rotate the carriage 58 about the pin 60. Movement of the carriage 58 is constrained by slots 62 in the side members 44 within which ride the ends of the pivot pin 48. A cross arm 64 is fixedly secured to the carriage 58, and extends to identical carriages on side poles (not shown).

Light extension springs 66 are connected on both sides of the contact arm 20 between a rod 67 (attached to the arm 20) and the carriage pivot pin 60. Heavy extension springs 68 are connected between the carriage 58 and a movable latch pin 70 which is free to ride in arcuate slots 72 on the frame side members 44. With the circuit breaker in the closed position as shown in FIG. 2, it can be seen that the latch pin 70 is drawn against a reaction surface 74 of the contact arm 20 by the action of the heavy extension springs 68. The springs 66 and 68 are thus extended in tension and the contact arm 20 floats in equilibrium between the contact force produced by positioning assembly 76, the forces from the springs 66 and 68, and a reaction force produced by the carriage 58 upon the contact arm pivot pin 48.

Figure 3:
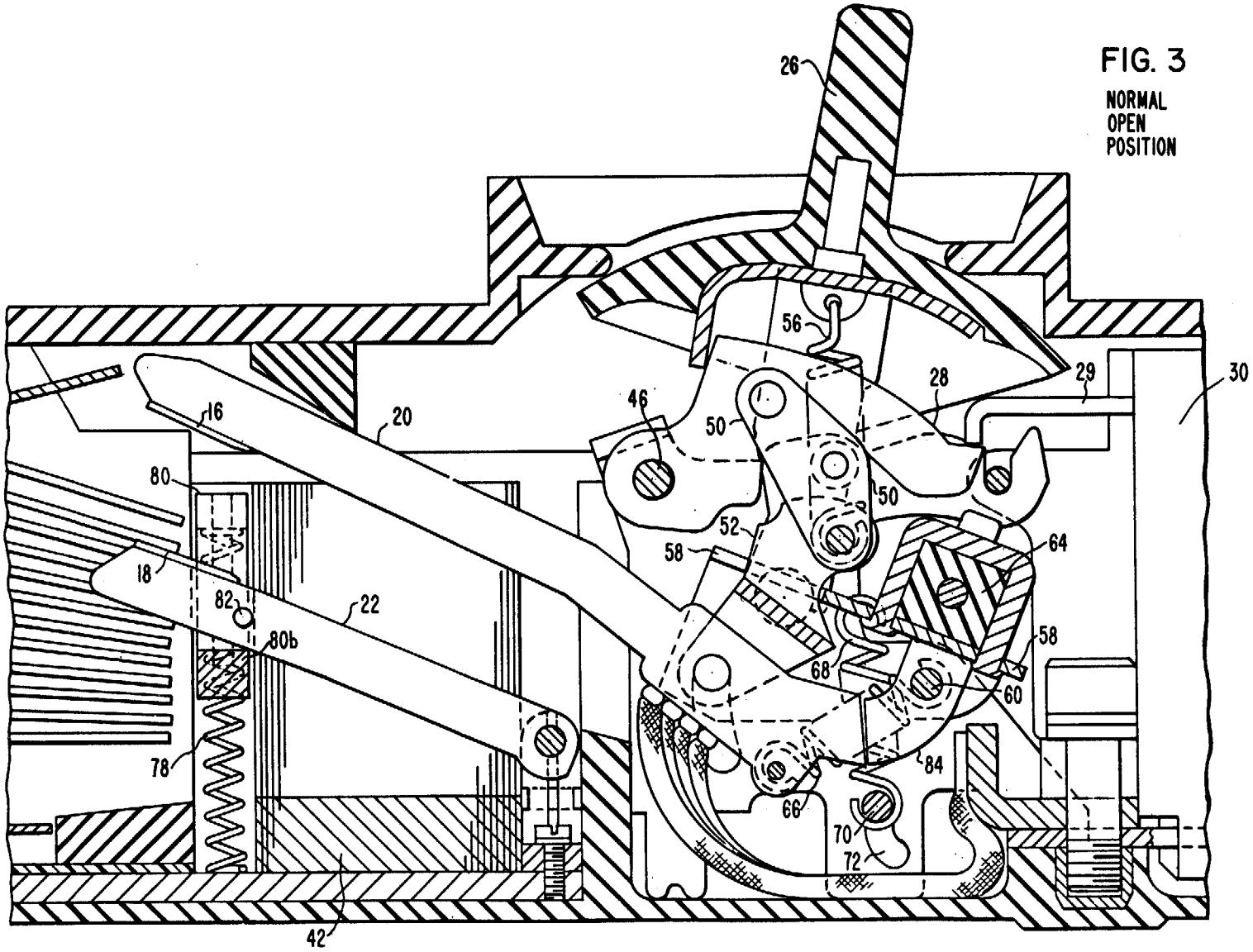
FIG. 3 is a view similar to FIG. 2, with the contacts and operating mechanism shown in the normal open position.

When the circuit breaker is operated to the normal open position by manual operation of the handle 26, the mechanism assumes the position shown in FIG. 3. As can be seen, the upper and lower toggle links 50 and 52 have collapsed, allowing the carriage 58 to rotate in a clockwise direction about the carriage pivot pin 60. The upper contact arm 20 has also pivoted as a unit with the carriage 58 to separate the contacts 16 and 18. The light extension springs 66 operate upon the upper contact arm 20, drawing it up against a pickup block 84 attached to the carriage 58. Force from the heavy spring 68 is no longer acting upon the contact arm 20, since the latch pin 70 (through which the spring force acts upon the arm 20 when the circuit breaker is in the closed position) is constrained by the upper end of the slot 72 and is no longer in contact with the contact arm 20. The lower contact arm 22 has risen slightly from its closed position shown in FIG. 2 to the position shown in FIG. 3 under the action of the compression spring 78. The upper limit of travel of the lower contact arm 22 is determined by the action of the limit pin 82 against the side of the slot motor 42.

Figure 4:
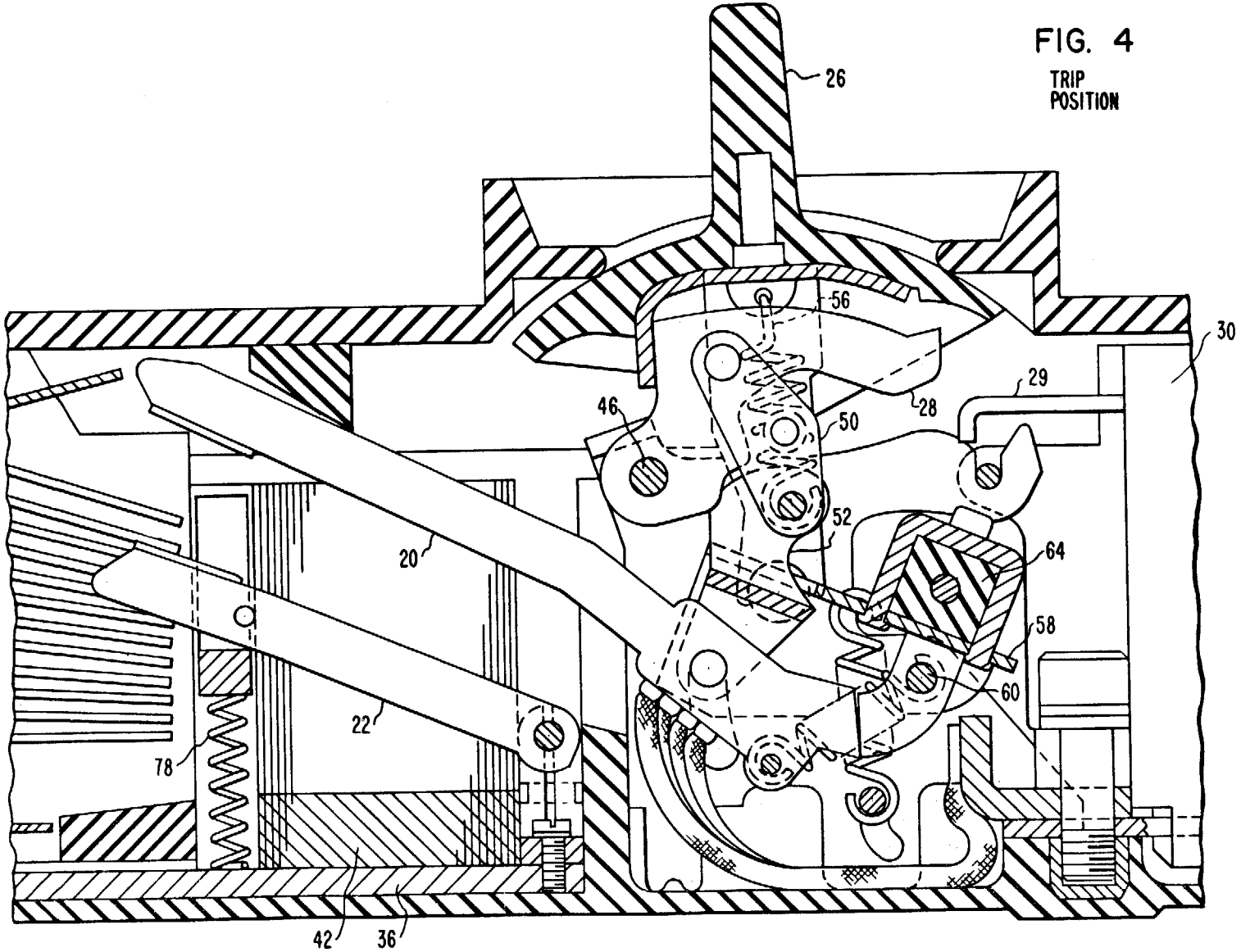
FIG. 4 is a view similar to FIGS. 2 and 3, with the contacts and mechanism shown in the tripped position.

Under low to moderate overload conditions with the circuit breaker in the closed position of FIGS. 1 and 2, the trip device 30 will actuate to move the member 29 and release the trip latch 28. The circuit breaker will then assume the position shown in FIG. 4. The trip latch 28 rotates in a counterclockwise direction about the latch pivot 46 under the influence of the extension operating spring 56. This causes the toggle linkage composed of links 50 and 52 to collapse, allowing the carriage 58 to rotate in a clockwise direction about the carriage pivot pin 60. The handle 26 is moved to the center trip position as shown in FIG. 4, and the cross arm 64 rotates with the carriage 58 to open the other poles of the circuit breaker. All other members of the circuit breaker assume the same positions as in the normal open position shown in FIG. 3.

Severe overload currents flowing through the circuit breaker 10 when in the closed position shown in FIG. 2 generate high electrodynamic forces upon the contact arms 20 and 22 tending to separate the contacts 16 and 18 and pivot the arms 20 and 22 in opposite directions. An additional separation force is provided by the current flow through the conductor 36 and arm 22 which induces magnetic flux in the slot motor 42 to pull the arm 22 against the action of the springs 78 toward the bottom of the slot. Since the trip latch 28 and toggle linkage 50, 52 are not immediately affected, they and the carriage 58 remain in the position shown in FIG. 2. Thus, the electrodynamic force upon the upper contact arm 20 causes it to rotate about the contact arm pivot pin 48. In the initial stages of this rotation, (FIG. 2) the reaction surface 74 bears upon the latch pin 70, causing the latch pin 70 to move downward in the guide slot 72. At first, the pin 70 moves downward in the guide slot 72 against the action of the spring 68. The force of the spring 68 therefore increases proportionately with the displacement of the contact arm 20, resisting the electrodynamic force caused by overload current and tending to oppose the current limiting action. However, the guide slot 72 is shaped to push the latch pin 70 away from the contact arm 20, and about halfway through the travel of the contact arm (before the spring 68 has appreciably extended), the reaction surface 74 disengages from the latch pin 70, allowing the released force of the spring 68 to pull the latch pin 70 to the top of the guide slot 72. The point at which disengagement occurs between the contact arm 20 and latch pin 70 can, of course, be regulated by proper design of the guide slot 72.

Figure 5:
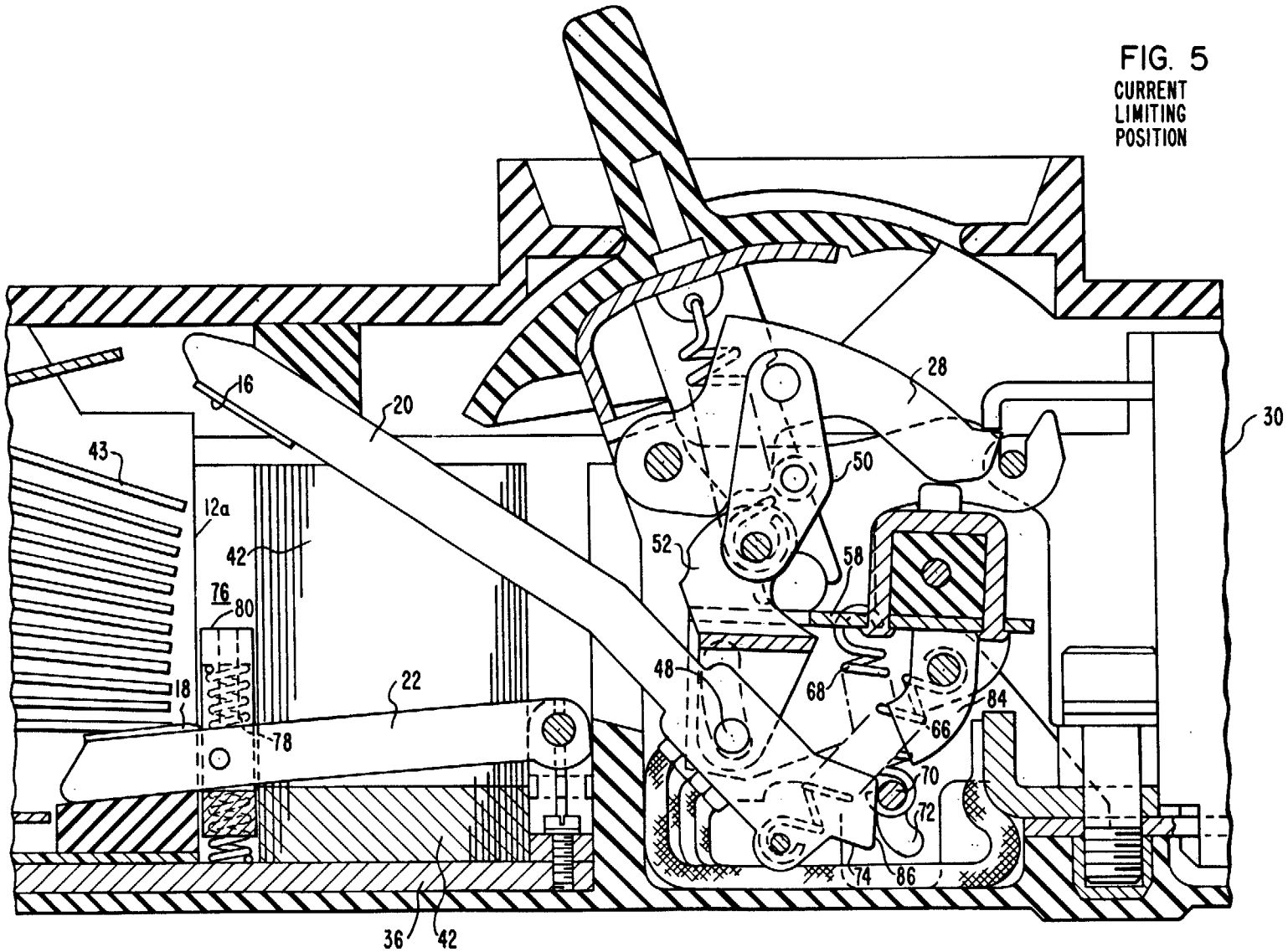
FIG. 5 is a view similar to FIGS. 2 through 4, with the contacts and mechanism shown in a current limiting position.

As can be seen in FIG. 5, when the latch pin 70 is at its upper extremity in the slot 72, it bears against a latch surface 86 of the contact arm 20. Thus, even though the light extension spring 66 is applying force tending to rotate the contact arm 20 in a counterclockwise direction and return the arm 20 to a closed circuit position, this tendency is prevented by the latchig action of the latch pin 70.

As the arms 20 and 22 move to the current limiting position of FIG. 5, an arc is drawn between contacts 16 and 18. Although this arc is forced against the plates 43 and is fairly rapidly extinguished thereon, the current flow until arc extinction is sufficient to activate the trip device 30 to release the trip latch 28. This action allows the carriage 58 to rotate in a clockwise direction and the latching surface 86 to ride upward along the latch pin 70 until it is released therefrom. When the carriage 58 has rotated a degree sufficient to release the surface 86 from the latch pin 70, the light extension spring 66 pivots the contact arm 20 in a counterclockwise direction until the surface 86 contacts the pickup block 84. At this time, the circuit interrupter assumes the position shown in FIG. 3.

It can be seen that the amount of contact closing force present during normal closed circuit conditions can be determined by proper selection of the characteristics of the spring 68. This force can then be released from the contact arm at any desired point in the current limiting pivoting action of the contact arm 20 by proper selection of the position and shape of the guide slot 72. By providing for early release of the contact arm 20, the force resisting acceleration of the arm 20 can be minimized since the spring 68 will not have stretched to produce a higher spring force. This not only increases the current limiting effect of the circuit breaker but reduces mechanical stress on the contact arm during the current limiting process.

Figure 6:
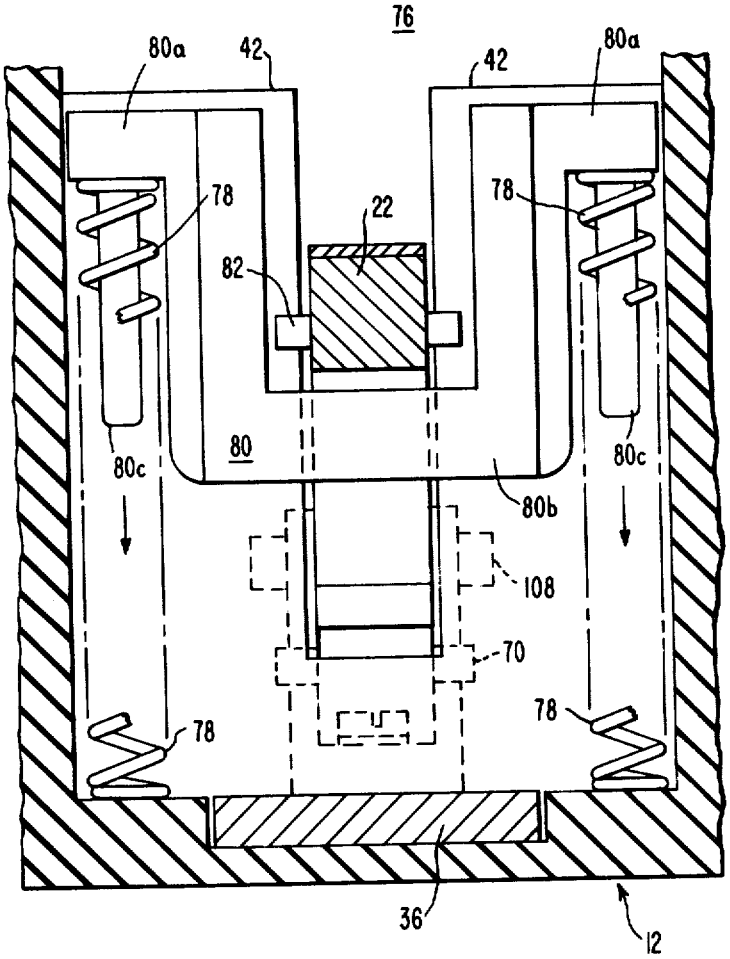
FIG. 6 is a detail sectional view taken along the line VI—VI of FIG. 1.

FIG. 6 shows the structure of the positioning assembly 76 in greater detail. The springs 78, in compression, bias ears 80*a* of the bearing member 80 upward, urging the bearing member cross portion 80*b* against the lower surface of the lower contact arm 22. The arm 22 thus pivots upward about the pin 108 until the lower contact 18 encounters the upper contact and arm, 16 and 20, respectively (as shown in FIG. 2). The force of the springs 78 thus balances the force of the springs 66 and 68 to produce contact closing force. Pins 80*c* prevent the springs 78 from buckling as the bearing member 80 moves up and down between the slot motor housing 42 and a wall 12*a* of the housing 12.

When the upper arm 20 rotates in a counter-clockwise direction to the normal open position (FIG. 3) it can be seen that the lower arm 22 rises slightly until the pin 82 contacts the edge of the slot motor 42 thereby passively positioning the arm 22 in the normal open position. The arm 22 is thus limited in its travel and is prevented from contacting the upper arm 20 with the breaker in an open position, yet the springs 78 remain loaded.

Operation of the breaker to the closed position causes the upper arm 20 to swing down and close the contacts 16 and 18. Since the springs 78 are still partially compressed at the point of initial contact of the two arms, however, the force resisting the continued downward travel of the arm 20 is such that only a small amount of further travel is permitted until the force produced by springs 78, 66, and 68 is once again balanced. The amount of this overtravel is just enough to produce a small amount of contact wiping action, yet not enough to produce excessive contact wear. The amount of contact closing force will thus remain relatively constant over the life of the contacts.

The use of the positioning assembly 76 and limit pin 82 as shown in FIG. 6 provides contact closing force when the breaker is in the closed position, yet prevents the lower arm 22 from contacting the upper arm 20 when the breaker is in the open position. Furthermore, the need for critical positioning of the lower arm 22 is eliminated. The limit pin 82 also allows the springs 78 to be preloaded in such a manner that the overtravel (displacement from open to closed position) of the lower arm 22 and variation of contact force with contact wear are both minimized.

It can be seen therefore that the present invention provides an improved current limiting circuit breaker having increased performance.

We claim:

1. A circuit interrupter, comprising:

separable contacts;

an arm assembly comprising first and second pivoting contact support arms supporting said contacts at the ends thereof and operable between open and closed positions;

an operating mechanism connected to said second arm for moving said contacts between open and closed positions;

a passive arm positioning member extending through said first contact support arm to limit travel of said first arm in a direction toward said second arm;

an active arm positioning assembly comprising a bearing member abutting said first contact arm on the side opposite said second contact arm and a spring biasing said bearing member against said first arm in a direction toward said second arm; and conductor means connected to said contact support arms adapted to connect said circuit interrupter in series with an electrical circuit being protected, said conductor means so arranged that current flow through said contact support arms is in opposite directions.

2. A circuit interrupter as recited in claim 1 wherein said bearing member abuts said first contact arm at a point on the same side of the pivot point of said first contact arm as said contacts.

3. A circuit interrupter as recited in claim 2 wherein said positioning assembly comprises a pair of springs.

4. A circuit interrupter as recited in claim 2 wherein said passive arm positioning member extends through said first contact arm in a direction parallel to the pivot axis of said first contact arm.

5. A circuit interrupter as recited in claim 4 wherein said first contact arm is connected to said conductor means with a clinch-type contact.

6. A circuit interrupter as recited in claim 1 comprising a slot motor magnetic drive device disposed about said first contact arm.

7. A circuit interrupter as recited in claim 6 wherein said bearing member abuts said first contact arm at a point on the same side of the pivot point of said first contact arm as said contacts.

8. A circuit interrupter as recited in claim 7 wherein said positioning assembly comprises a pair of springs.

9. A circuit interrupter as recited in claim 8 wherein said passive arm positioning member extends through said first contact arm in a direction parallel to the pivot axis of said first contact arm.

10. A circuit interrupter as recited in claim 9 wherein said first contact arm is connected to said conductor means with a clinch-type contact.

* * * * *